US007367661B2

(12) United States Patent
Hess et al.

(10) Patent No.: US 7,367,661 B2
(45) Date of Patent: May 6, 2008

(54) LOW-COST LIQUID DROPLET SPRAY DEVICE AND NOZZLE BODY

(75) Inventors: Joseph Hess, Bevaix (CH); Jean-Marc Flick, Savagnier (CH); Bo Hu, Neuchatel (CH); Philippe Luginbuhl, Nods (CH); Raphael Weber, La Chaux-de-Fonds (CH)

(73) Assignee: Microflow Engineering SA, Peseux (CH)

( * ) Notice: Subject to any disclaimer, the term of this patent is extended or adjusted under 35 U.S.C. 154(b) by 183 days.

(21) Appl. No.: 10/824,658

(22) Filed: Apr. 15, 2004

(65) Prior Publication Data

US 2004/0263567 A1 Dec. 30, 2004

(30) Foreign Application Priority Data

Apr. 15, 2003 (EP) ..... 03008077

(51) Int. Cl.
*B41J 2/175* (2006.01)

(52) U.S. Cl. ..... 347/86; 347/85; 347/22; 239/302; 239/303; 239/338; 239/337; 239/398; 239/418; 239/102.1; 239/102.2

(58) Field of Classification Search ..... 347/56, 347/85, 86, 22; 239/302, 303, 337, 398, 239/418, 102.1, 102.2, 338
See application file for complete search history.

(56) References Cited

U.S. PATENT DOCUMENTS 4,193,398 A * 3/1980 Refson ..... 604/131
4,434,430 A * 2/1984 Koto ..... 347/70
5,526,957 A * 6/1996 Brown et al. ..... 222/94
5,900,894 A * 5/1999 Koizumi et al. ..... 347/65
6,142,607 A 11/2000 Takata et al.
6,523,762 B1 * 2/2003 Luginbuhl et al. ..... 239/589
6,669,333 B1 * 12/2003 Silverbrook ..... 347/54
6,766,817 B2 7/2004 da Silva
2001/0006396 A1 * 7/2001 Iida ..... 347/86

(Continued)

FOREIGN PATENT DOCUMENTS

EP 0 923 957 A1 6/1999

(Continued)

OTHER PUBLICATIONS

European Search Report for the corresponding European application, completed Aug. 26, 2003, at the Hague, by J. Roldan.

*Primary Examiner*—Manish S. Shah
*Assistant Examiner*—Laura E. Martin
(74) *Attorney, Agent, or Firm*—Griffin & Szipl, P.C.

(57) ABSTRACT

The invention concerns a nozzle body for a liquid droplet spray device for atomising a high viscous liquid substance such as perfume. A first and second substrate enclose a space for containing the liquid substance. Outlet means are arranged in the second substrate and have at least one outlet nozzle and at least one output channel, said output channel having straight side walls. Each output channel has a stepped shape having a wider portion and a thinner portion, the wider portion being arranged adjacent the space. The thinner portion contains a protrusion section protruding beyond the top surface of the second substrate such that the exterior side wall of the protrusion section is at a substantially straight angle with respect to the top surface of the second substrate.

18 Claims, 5 Drawing Sheets

U.S. PATENT DOCUMENTS

| | | | | |
|---|---|---|---|---|
| 2002/0070239 | A1 | 6/2002 | Garcia et al. | |
| 2002/0158952 | A1* | 10/2002 | Adachi et al. | 347/100 |
| 2003/0063162 | A1* | 4/2003 | Yoshihira et al. | 347/65 |
| 2003/0085966 | A1* | 5/2003 | Hartman | 347/85 |
| 2003/0107159 | A1* | 6/2003 | Adachi et al. | 264/494 |
| 2003/0168524 | A1* | 9/2003 | Hess et al. | 239/306 |

FOREIGN PATENT DOCUMENTS

| | | | |
|---|---|---|---|
| EP | 1 005 916 | A1 | 6/2000 |
| EP | 1 149 602 | A2 | 10/2001 |
| EP | 1 273 355 | A1 | 1/2003 |
| EP | 1273355 | A1 * | 1/2003 |
| WO | WO 00/06388 | | 2/2000 |

* cited by examiner

LOW-COST LIQUID DROPLET SPRAY DEVICE AND NOZZLE BODY

This application claims priority from European Patent Application No. 03008077.4, filed Apr. 15, 2003, the entire disclosure of which is incorporated herein by reference.

FIELD OF THE INVENTION

The present invention relates to a liquid droplet spray device suitable for atomising a liquid substance, in particular a highly viscous liquid substance such as a personal or an ambient fragrance or a functional liquid such as an insecticide or a medicated liquid. Such a device may be used, e.g., for fragrance or functional liquid dispensers, for inkjet printer heads, or for controlled deposition of an array or arrays of droplets on a surface. The device delivers the liquid substance as a tight dispersion of atomised droplets. More specifically, the present invention concerns a low-cost liquid droplet spray device which efficiently creates and fully expels a liquid droplet spray and prevents leaking of the liquid in various dispensing, storage or carrying positions. More specifically, the present invention relates to a nozzle body for such a liquid droplet spray device.

BACKGROUND OF THE INVENTION

Various devices are known for atomising a liquid. For example, the documents EP-A-0 923 957 and EP-A-1 005 916, both in the name of the present Applicant describe a liquid droplet spray device. A brief description of the liquid droplet spray device known from these documents, which are hereby incorporated by reference, is given here while referring to FIG. 1.

In this particular embodiment spray device 1 consists of a housing formed of a superposition of a first, or a top substrate 5 and a second, or a bottom substrate 6 in-between which a chamber or a space 2 is formed for containing a liquid substance 3 and thus providing a capillary filling and compression chamber. Top substrate 5 contains outlet means consisting of cavity or cavities 7 which can partly constitute space 2, outlet nozzles 9 and output channels 10 connecting these nozzles to space 2.

Liquid substance 3 enters spray device 1 by way of, e.g., a very low pressure, e.g., around a few millibar or slightly negative pressure, or capillary action. This can be achieved for example by way of at least one input tube or needle 4 through which the liquid substance may be supplied from an external reservoir (not shown) into spray device 1. Spray device 1 further comprises a vibrating element 8, e.g. a piezoelectric element to cause vibration of liquid substance 3 in space 2.

The method of manufacturing this device is carried out by using technology known from the field of semiconductors. Thus, top and bottom substrates may be manufactured in a similar manner e.g. by etching a silicon wafer in a suitable manner, e.g. by wet or dry etching and by using one or more masks or by micro-machining Pyrex wafers. The substrates 5 and 6 are attached to each other, preferably by appropriate bonding technique, such as anodic bonding, so as to form and enclose space 2.

These prior art documents further describe techniques allowing for output channels with a straight, non-tapered profile. This provides for a precisely defined pressure drop, droplet size and flow behaviour across output channel 10 for aqueous solutions and suspensions whereas the relatively smooth surface is suited for medications carrying small solid particles, e.g. from less than 1 to approx 2 μm, in suspensions. But output channels with a straight, non-tapered profile are also suitable for more viscous liquids, such as ambient fragrances which depending on the fragrance concentration however would normally tend to wet the surface of top substrate 5 and therefore might inhibit effective dispensing of such liquids.

The same effect can be obtained proportionally with larger dimensions, e.g. with nozzles of 10 μm or larger for example for personal perfume or for functional liquid dispensing applications or in a practical variation of the cited prior art of the applicant by simply using the vertical plasma etching micro-machining method to produce an output channel whose cross-section is divided into two or more identical sub-channels to allow for an even finer control of pressure drop, droplet size and flow behaviour across said channel 10. The cross section of the vertical channel or channel section can be of a suitable geometrical form, e.g. circular, triangular or a suitable geometrical shape such as a cross when the channel consists of several identical sub-channels. The cross section of the cavities 7 can also be of suitable geometrical form or combination of forms.

FIG. 2*a* shows a schematic detailed view of the first, or top substrate of this prior art liquid droplet spray device. The top substrate is shown upside down with respect to FIG. 1 in a further practical variation of the cited prior art which has already been shown with an inversion of the bottom substrate, thus further reducing dead space. As can be seen, top substrate 5 comprises the cavities 7, output channels 10 and outlet nozzles 9. The top surface of the substrate-delimiting cavity 7 forms a membrane section in substrate 5.

The surface of this membrane section is much larger than the actual nozzle surface, so that it is possible to provide a very large number of outlet nozzles 9 on the membrane surface in order to eject more droplets simultaneously. As already mentioned in the cited prior art, it is obvious that cavities 7 are not necessarily tapered but can be straight according to the manufacturing process chosen. FIG. 2*b* shows a close-up view of a part of FIG. 2*a* in which it can be seen that the output channels 10 and outlet nozzles 9 may be readily placed according to the specific conditions.

The diameter of a droplet depends among other factors on the nozzle hole size "d" for a given frequency of the vibration of the liquid substance and the inlet pressure. In this prior art device where a frequency of around 250 kHz is used, the mean droplet diameter has been found to be around 5 μm, the diameter of the hole of nozzle 9 is around 7 μm and the inlet pressure is a few millibars. One such a droplet thus contains a quantity of around 67 femtolitres ($10^{-15}$ l) so that the number of nozzles may be determined as a function of the amount to be ejected.

The document EP 1 149 602 shows an embodiment where the top substrate may be micromachined in such a way as to provide recessed areas around the output nozzles such as shown in FIG. 4 of this document. Thus, the actual nozzle outlet protrudes from the main surface of the top substrate and contributes to the monodispersive nature of the ejected spray by providing minimum stiction surface for the liquid around the output nozzles. Alternatively if the total area constituted by the membrane section in substrate 5, meaning the total top surface of the substrate-delimiting cavity 7 is recessed, all output nozzles will protrude.

A further liquid droplet spray device is known from the document WO-A-00/06388. This device also has a first substrate provided with a piezo-electric vibrating element, and a second substrate provided with outlet means.

Both substrates enclose a chamber for containing a liquid substance, in a manner similar to the above-described prior art. The outlet means are manufactured in such a way that here too recessed areas are created around the nozzle outlets so that the outlet nozzles protrude from the main surface of the second substrate so as to reduce stiction.

However, these devices use expensive manufacturing techniques such as DRIE (deep Reactive Ion Etching) or plasma etching) and many manufacturing steps on a very large surface of silicon, resulting in a comparatively expensive device.

Further, it is known that the droplet diameter varies with certain physico-chemical properties of the liquid such as surface tension and viscosity. It is therefore important as shown in the cited prior art to be able to adapt the physical and electrical device parameters (frequency and amplitude) according to the liquid to be expelled and the desired droplet characteristics.

The applicant has now found that although the prior art device generally functions satisfactorily, the construction of this device has limits if it needs to be manufactured in a cheap manner, such as when used as a personal or ambient perfume dispenser instead of a very precise medication dispenser, thereby still ensuring sufficient rigidity and precision when manufacturing the nozzle outlet means and therefore complying with formal, informal or introductory specifications required by environmental and health related institutions.

Furthermore, when such a device is used to expel liquid substances of high viscosity such as perfume or some functional liquids, there is a much larger problem of retention of the liquid when being expelled from the nozzle outlet means leading to wetting and an uncontrollable droplet size, because portions of the droplets to be expelled may stick to the outer surface of the nozzles and create a thin liquid film there which will interfere with following droplets trying to detach from the nozzles. A higher power is then needed to actually cause the droplet to detach from the nozzle outlet, and if the power were not high enough, small droplets would then be released as a part and stay behind as a satellite droplet due to the retention with the film on the top surface surrounding the nozzle outlets caused by the stiction of the expelled liquid. For some liquids surface wetting due to retention forces being higher than dispensing forces will go beyond creating satellites, it may simply prevent droplet generation. This problem will be compounded if nozzles are set closer to each other for reasons of cost hence size reduction. Surface capillary forces will tend to create a liquid film connecting all nozzles.

For liquids requiring to be expelled in larger droplets and consequently being dispensed by nozzle outlets with larger diameters, the effect of retention on the surface might turn into a straightforward leakage, even if the device is passive and especially if it is held upside down. Up to a certain point, the use of flexible foil airless bags might prevent leakage, but as of a certain diameter of the outlet nozzle, this also becomes ineffective.

It is, therefore, an object of the present invention to provide a nozzle body for a liquid droplet spray device as well as a liquid droplet spray device that overcomes the above-mentioned inconveniences and that can be efficiently used for high viscous liquids such as perfumes or other non-aqueous solvent based liquids.

It is another object of the present invention to provide such a nozzle body and device that is simple, reliable and inexpensive to manufacture, small in size and low in energy consumption and cost, and as such suitable as a personal or ambient fragrance and functional liquid dispenser.

SUMMARY OF THE INVENTION

Thus, the present invention concerns a nozzle body and corresponding liquid droplet spray device as defined in the appended claims.

Thanks to the construction of the nozzle body according to the present invention an efficient device may be obtained in a relatively simple and inexpensive manner.

BRIEF DESCRIPTION OF THE DRAWINGS

Other features and advantages of the nozzle body according to the present invention will become clear from reading the following description, which is given solely by way of a non-limitative example thereby referring to the attached drawings in which:

FIG. 2 2*a* to 2*b* show schematic detailed views of the top substrate of the prior art liquid droplet spray device of FIG. 1.

DETAILED DESCRIPTION OF THE ILLUSTRATIVE EMBODIMENTS

An example of a preferred embodiment will be described hereafter. The present invention thus concerns a nozzle body for nebulising a liquid substance of high viscosity. In this respect, high viscosity means that it is 4 mPas (milli-Pascal second) or higher. The present invention also concerns a liquid droplet spray device incorporating such a nozzle body. For ease of understanding, the structure of the nozzle body and spray device will first be described while referring to FIGS. 3, 4 and 5. In principle, the spray device may be rather similar to the above described prior art spray device of the present applicant.

It should be noted, however, that due to the use of high viscous liquids such as perfume, the tolerance requirements of the present nozzle body are quite different from those of the above-mentioned prior art which concern spray devices for medical use. As the tolerance requirements are lower for perfume and other, the nozzle body can be made in a cheaper way.

Figure 1:
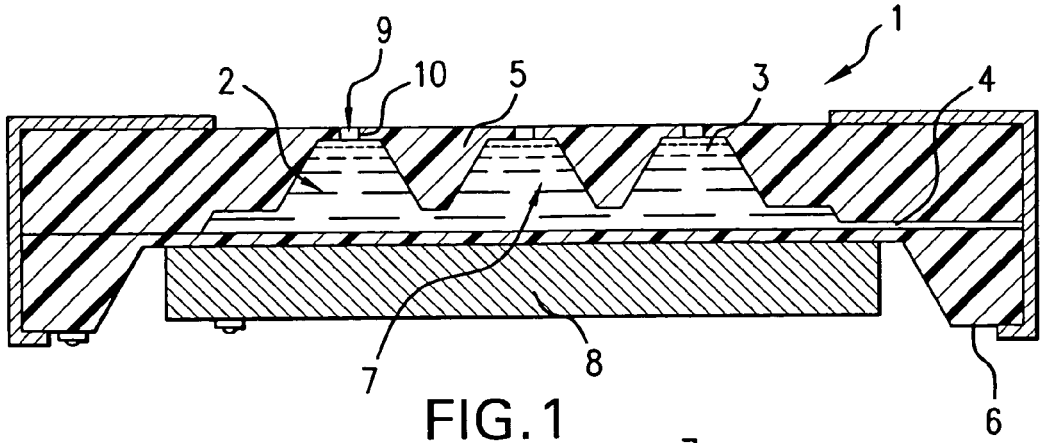
FIG.1 PRIOR ART
FIG. 1 is a schematic cross-section of a prior art liquid droplet spray device.
Figure 2A:
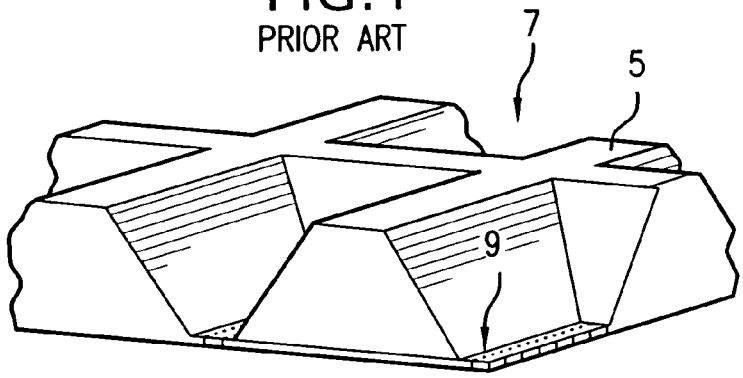
FIG.2A PRIOR ART
Figure 2B:
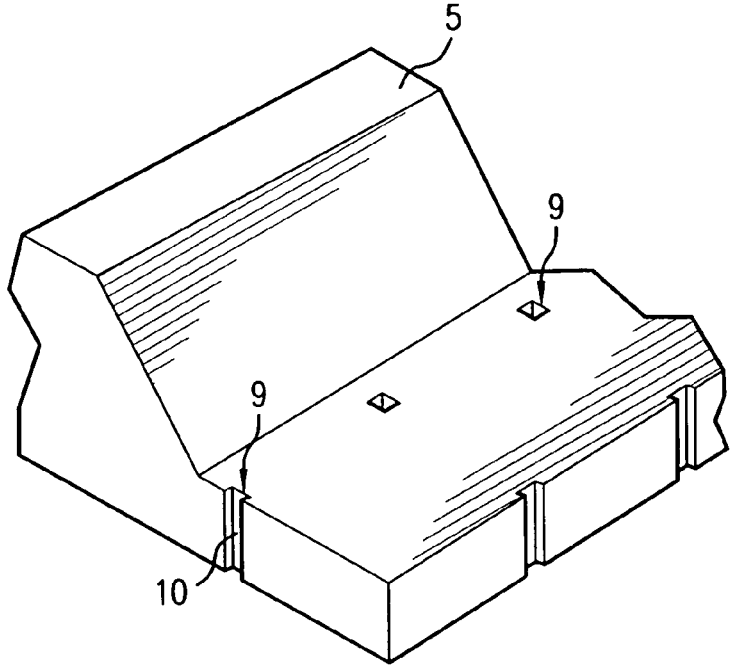
FIG.2B PRIOR ART

Thus, the present spray device also comprises a first substrate 2 and a second substrate 4 which enclose a space 3, in a rather similar manner as shown in FIG. 1. Space 3 constitutes a liquid substance chamber, for example for containing ambient or personal fragrance or some other highly viscous functional liquid, directly or entrapped in a soft porous medium. If the liquid is entrapped in a porous medium, it will not tend to wet the outside surface of substrate 4 or leak out. Such medium can have standard, micro- or nano-structured subparts and may be at the core or on the border surfaces of space 3, capillary channels 6 and/or a reservoir (not shown) which provides the liquid to space 3 via capillary channel 6. An example of an arrangement comprising such soft porous medium is described hereafter while referring to FIG. 6.

Figure 3:
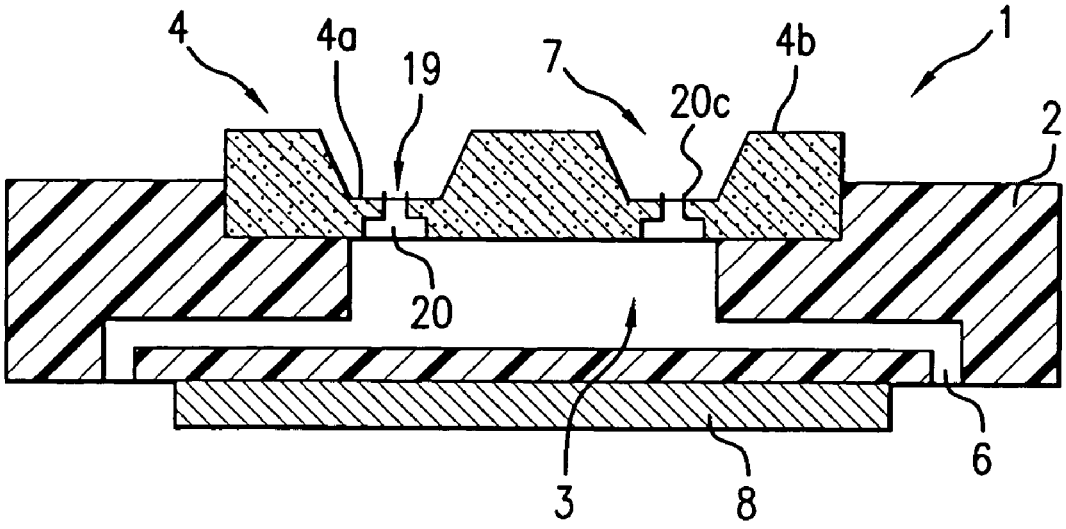
FIG. 3 shows a first example of a nozzle body and a liquid droplet spray device according to the present invention.

As shown in FIG. 3, first substrate 2 is placed upside down compared to first substrate 5 of FIG. 1. Substrates 2 and 4 form together a nozzle body 1, and may be formed by 2 parts as shown in FIG. 3. Substrate 2 can be made of a polymer and second substrate 4 can be made of silicon as described, another material or a sandwich of different or same materials such as described further on.

Second substrate 4 is provided with membrane sections 4*a* which are thinner sections of the substrate obtained by removing parts of the substrate using appropriate methods such as micro-machining to guarantee homogeneous membrane thickness. The manner of obtaining such membrane sections may be similar to that as described in the above referenced prior art document EP-A-0 923 957, and is well known to the skilled person from the field of semiconductor etching.

The etching may be done by wet or dry etching resulting in a cavity 7 with inclined or with straight sidewalls where the bottom of the cavity constitutes the membrane section. The non-etched sections of the second substrate 4 constitute reinforcement sections 4*b* thus surrounding the membrane sections 4*a*. These reinforcement sections provide the required rigidity to the nozzle body to avoid it breaking up when pressure is applied to a liquid substance contained in space 3.

Alternatively substrate 4 can also be constituted as a metal structure whose critical parts have been advantageously manufactured by low cost LIGA (Lithography defined galvanic deposition). This metal structure, which may be Nickel or the like, can then be assembled as a sandwich between part 4*a*, corresponding to the membrane section and part 4*b*, corresponding to the re-enforcement section.

Alternatively substrates 2 and 4 can also be machined integrally from one single piece. For example, by using ion or proton beam internal 3D micro-machining, it is possible to obtain a space within a single polymer blank substrate, such that substrate components 2 and 4 are actually formed from and within a single substrate.

Another possibility is to have a plastic substrate 4 with a silicon insert, or the like, forming the membrane section 4*a*, or to have the membrane section 4*a* and the surrounding substrate area formed in a negative, epoxy-type, near-UV photoresist based on EPON SU-8 epoxy photosensitive resin such as SU8.

Space 3 is preferably formed in first substrate 2, for example by etching a recess in a main surface of first substrate 2.

Further, appropriate means, such as a capillary channel 6 for supplying the liquid substance to and allowing exiting from space 3 is provided as known from the mentioned prior art. Such a capillary channel can be advantageously configured to act as a passive valve or as a capillary intersection for a manually activated valve. These are known as such and serve to allow the liquid substance to enter and exit the space or chamber 3.

Figure 6:
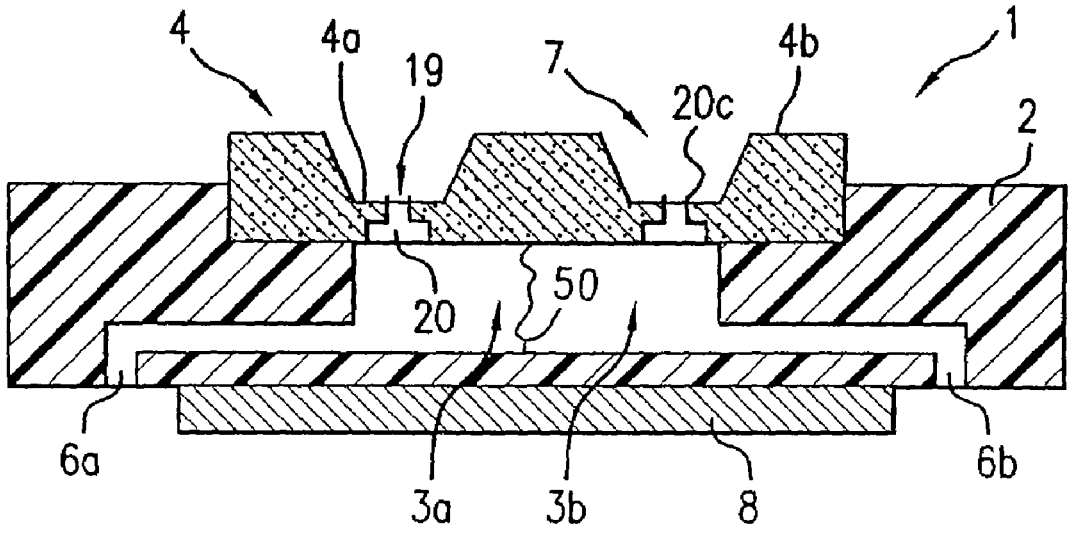
FIG. 6 shows a second example of a nozzle body and a liquid droplet spray device according to the present invention.

For some applications it is advantageous to be able to eject two different liquids stemming from 2 different reservoirs contained within the same liquid droplet spray device through the same nozzle outlet means of the that device. To this effect, in an alternative arrangement, it is possible to split space 3 into two sub-spaces 3*a* and 3*b* via a thin, leak-tight membrane 50 or other gasket type vertical separation located in space 3. Each sub-space is connected to a reservoir, for example by way of its own capillary channel, thus allowing to feed two different liquids to be ejected together through the nozzle membrane section. A schematic representation of such sub-spaces is shown in FIG. 6.

Capillary channel 6 can also contain a soft porous medium, standard, micro- or nano-structured, connected on one side to space 3, which itself may also contain such soft porous medium, and connected on another side into the reservoir such as an airless bag or other known reservoir for viscous liquids such as personal or ambient fragrances and functional liquids such as insecticides.

At least one outlet nozzle 19 and at least one output channel 20 for connecting space 3 to each outlet nozzle 19 are further provided in the thinner membrane section 4*a* of second substrate 4. It is of course important that the output channel 20 has straight sidewalls so as to be able to define the pressure drop across the channel when a droplet is ejected, as already explained in detail in the above-mentioned prior art EP-A-0 923 957.

A vibrating element such as a piezoelectric element 8 may be disposed on first substrate 2 to vibrate any liquid substance in space 3. Said vibration can be transmitted advantageously via a thin metal membrane joined both to substrate 2 and piezoelectric element 8. More preferably, the vibrating element is arranged separately from first substrate 2 and can be brought into tight contact with nozzle body 1 by using appropriate attachments means. These attachment means thus allow to fixedly or removably attach the vibrating element to first substrate 2, for example by clamping means or by adhesive surface treatment. Such attachment means are known as such, see for example the previously cited document EP-A 0 923 957. When the liquid is excited at an appropriate frequency and under the appropriate pressure, it will be ejected as a spray of droplets through the outlet nozzles with a very low exit velocity. The preferred operation is at the fundamental resonance frequency or at related harmonics.

Figure 7:
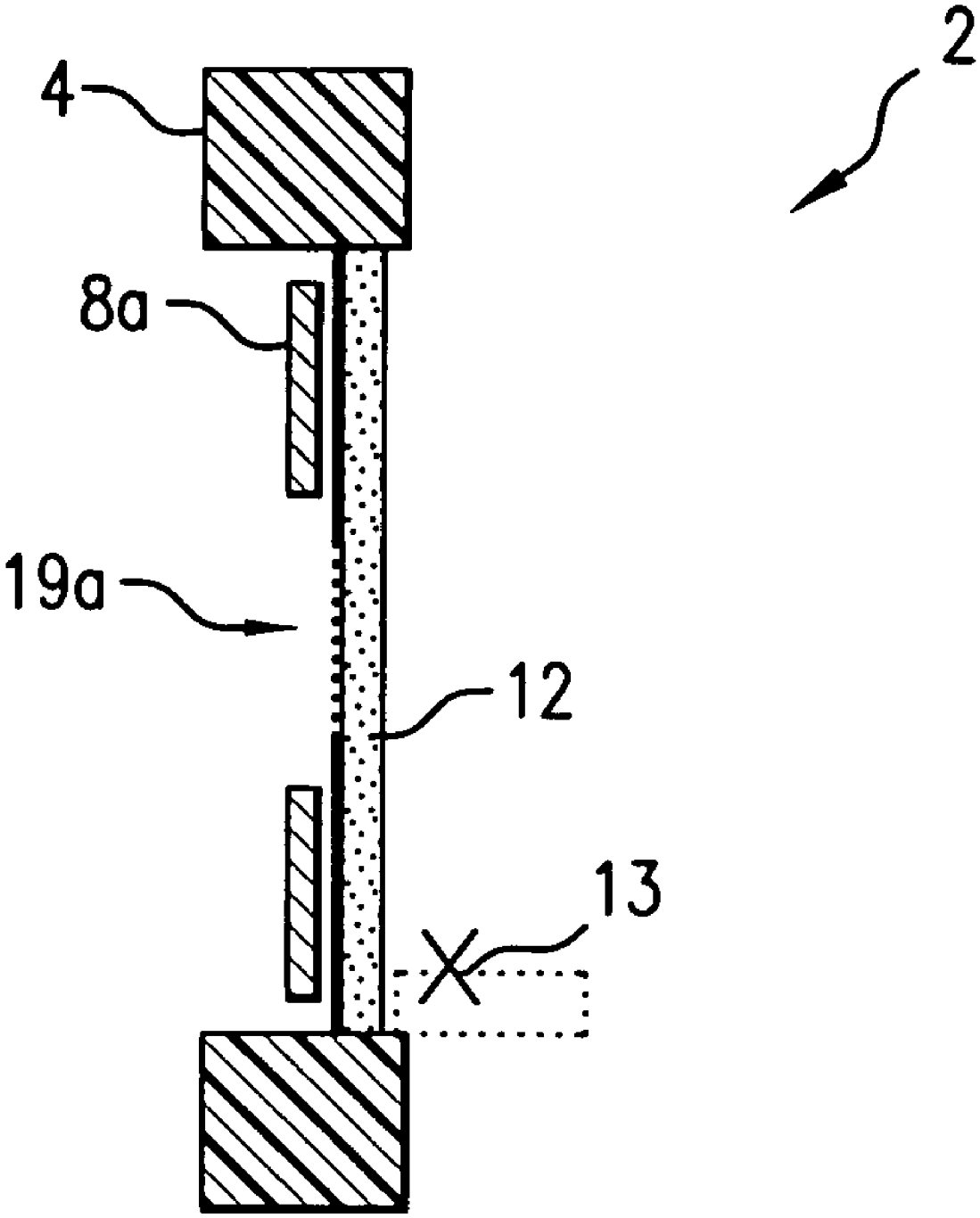
FIG. 7 shows an example of a device with the internal space being constituted according to a variation of FIG. 3 and enclosing a soft, porous material entrapping the liquid to be expelled.

In a variant, the vibrating means may be arranged to be in direct contact with second substrate 4, in such a way that it does not impair vibration of the membrane section(s), as shown for example in FIG. 7.

Figure 4:
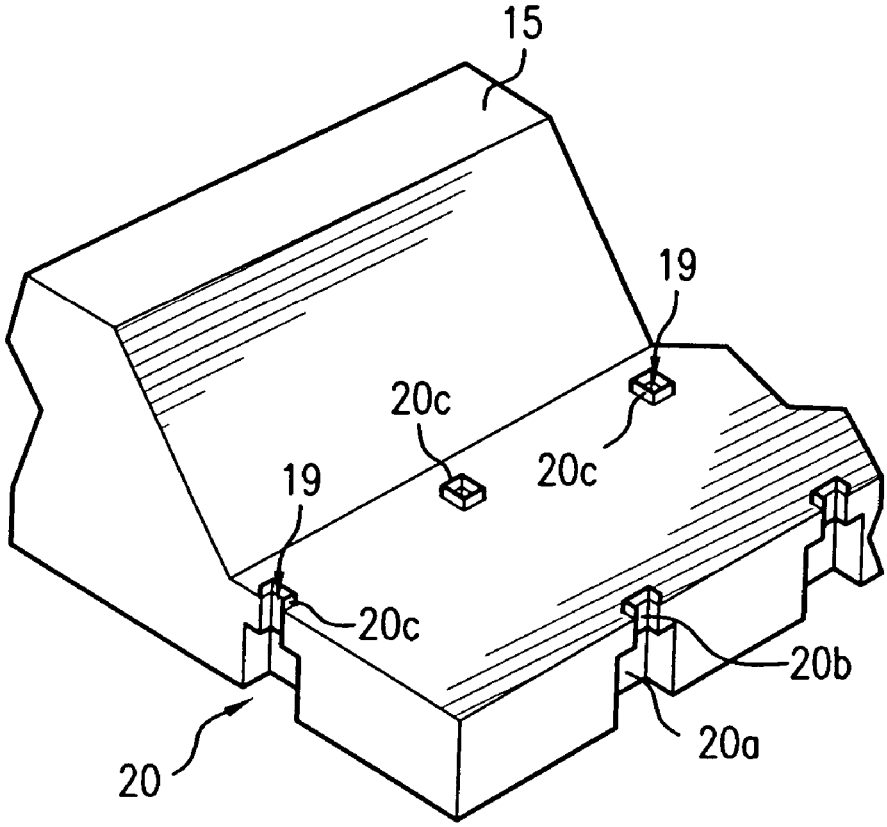
FIG. 4 shows the outlet means of the nozzle body of FIG. 3.

The transition of output channel 20 from space 3 to outlet nozzle 19 is not only non-tapered and straight, but is also step-shaped. As can be seen in FIG. 4, output channel 20 consists of a wider portion 20*a* and a thinner portion 20*b*. Wider portion 20*a* of output channel 20 has a larger diameter than thinner portion 20*b* and can have the same or a different length as the thinner portion. In a preferred embodiment, the length of wider potion 20*a* is around 15 μm. Wider portion 20*a* is arranged adjacent space 12 containing the liquid substance which is to be expelled.

Thanks to the stepped shape of the output channel 20, the excited liquid is forced at a higher pressure into the thinner portion 20*b* of the output channel. Thus, the eventual size of the droplet results mainly from the liquid volume that is contained in the thinner portion 20*b*.

Figure 5:
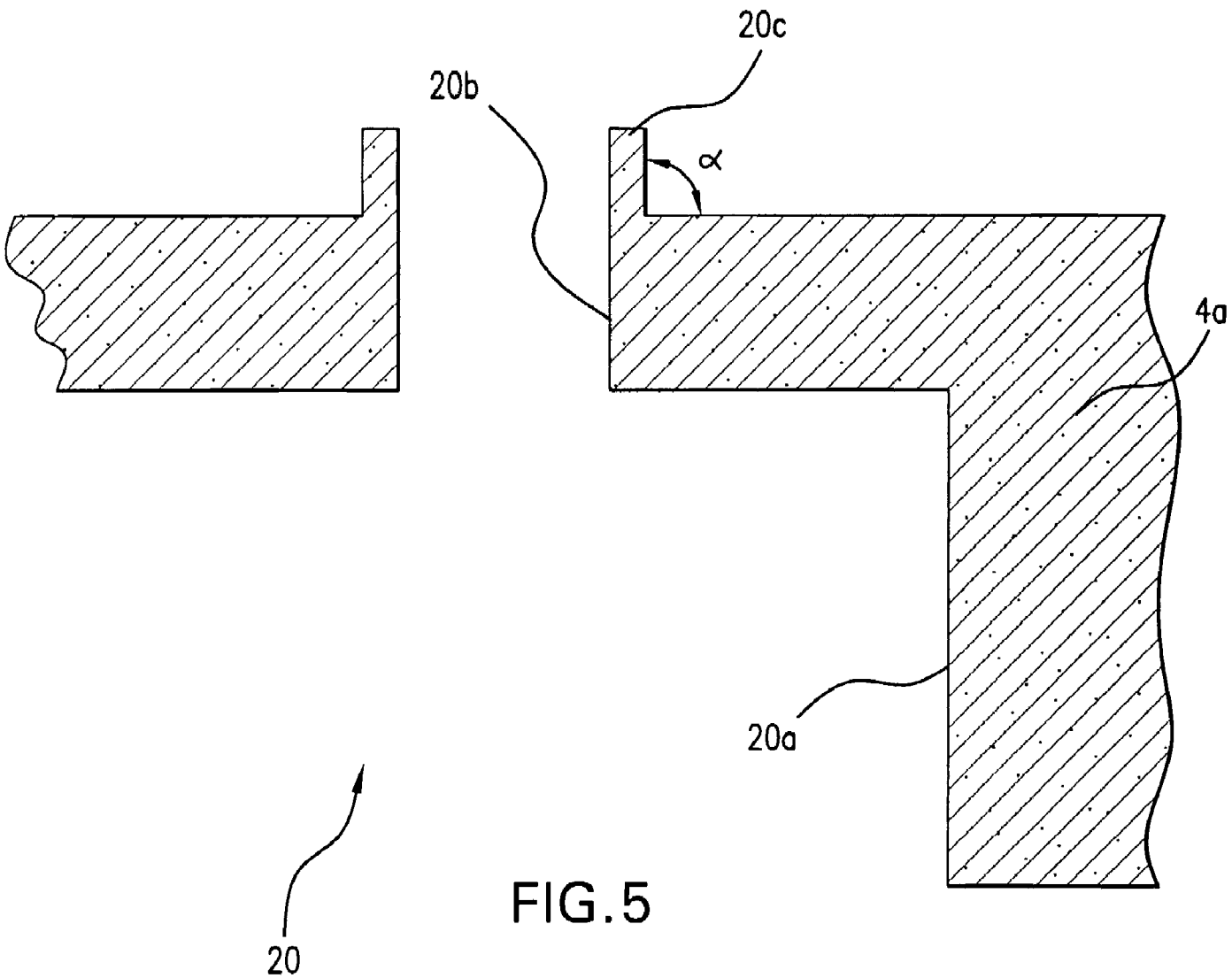
FIG. 5 shows in more detail an output channel of the outlet means of FIG. 4.

According to the present invention, thinner portion 20*b* of output channel 20 further has a protrusion section 20*c*, which extends beyond the top surface of second substrate 4, as also shown in FIG. 5. According to the present invention this protrusion section 20*c* is applied independently of the use or intended application but as of a certain set of physico-chemical set of parameters and is manufactured in such a manner that its exterior side walls are at an angle $\alpha$ that is substantially straight with respect to the top surface of the second substrate 4, i.e. $\alpha \approx 90°$. As an example, the total length of the thinner portion may be 7.5 μm, with the thinner portion contained within second substrate being around 5 μm, and the length of the protrusion section 20*c* being around 2.5 μm. The thickness of the exterior sidewalls may be around 0.5 to 1.5 μm, preferably around 1 μm. This thickness should be as small as possible, but should be sufficiently thick to avoid breaking of the nozzle when liquid is expelled there through.

As the present nozzle body is designed for expelling highly viscous liquids such as fragrant and functional liquids with their solvents, the dimension of the nozzle outlet may not be chosen to be too small or too large.

Thus, the diameter of the nozzle outlet 19 must be chosen such that expelled droplets are not too small or not too large in diameter.

Indeed, the nozzle diameter chosen for a given application depends on the viscosity of the liquid. If the viscosity is 4 mPas or less, the nozzle diameter should be up to around 7 μm. When the viscosity is over 7 mPas, the nozzle diameter should be more than 7 μm, say around 17 μm for a viscosity of around 7 mPas for a given electromechanical energy delivery. Nozzle diameters will be larger still, say up till 25 μm, if the viscosity goes up to around 10 mPas. This means that there is a strong correlation between the viscosity of the liquid substance and the nozzle diameter. The higher the viscosity, the larger the diameter so as to ensure correct expulsion of droplets.

In either case, thanks to the protrusion section 20*c* of output channel 20, there is a minimal risk of retention of the high viscous liquid when expelled, i.e. the droplet leaving the nozzle outlet 19 will fully depart from the nozzle body without entering into contact with any liquid film covering the surface of the nozzle body. This means that less power is required to expel the droplet, as there is nothing holding it back. Further, the actual size of the droplet being expelled will be slightly larger than when there is retention or stiction due to the fact that there is no loss of liquid due to stiction. This reduction in stiction is further enforced by the substantially straight angle a of the sidewalls of the output channel with respect to the top surface of second substrate 4.

It should be noted that the length of the protrusion section 20*c* of the output channel should be chosen such that the nozzle outlet is sufficiently far way from the top surface to avoid stiction, but not long enough to require a high power for expelling the droplets due to increased pressure drop across the output channel.

Furthermore, by using such protrusion sections, and thus by avoiding stiction, it is possible to provide a higher density of output nozzles in one single cavity or membrane section, because there is no dispersion of liquid on the top surface of the second substrate, i.e. on the bottom of the cavity constituting the membrane section 4*a*. For example the present Applicant has found that such protrusion sections allowed to place 5300 nozzles on a surface of second substrate 4 corresponding to more than 15 membrane sections 4*a* whereas before 1300 nozzles were placed on a surface of more than 50 membrane sections 4*a*, resulting in the same or better flow rate.

In fact, according to the present invention, a high density is necessary to obtain a low-cost device. High density means in this respect at least 85 nozzles on a 500×500 μm membrane section. Preferably, high density means at least 169, or even above 169, and more preferably above 300 nozzles for a 500 $\mu m^2$ membrane.

Moreover, by having the exterior side wall of the protrusion sections at a substantially straight angle, any liquid that is not fully released from the nozzle outlet will immediately flow down the outside of the output channel and will thus not interfere with a following droplet. Indeed, if this angle $\alpha$ is not substantially 90°, there is a high risk of accumulated retention of the following droplets by any remaining liquid and finally spreading on the surface of membrane section 4*a*.

Also, as mentioned above, for a same diameter of the nozzle output channel, larger droplets will be expelled, so that again a higher density of channels and outlets may be provided within a single cavity.

Each cavity contains a plurality of outlets. For example, as mentioned before it is possible to provide a very high number such as 169 or more outlets in a single cavity 7 or on a single membrane section 4*a*, versus 25 or 49 such as used in prior art devices.

Furthermore, due to the features of the output channel and its protrusion section, the top surface of second substrate will remain substantially free of liquid. Thus, it is therefore possible to remove the nozzle body from a vibrating element and replace it with another nozzle body without any liquid spilling out. This also allows for a low cost dispenser as the same vibrating element may be used many times for several liquids. Thus, in such a case, the nozzle body may be conceived as a disposable cartridge that can be fixed to the vibrating element to function as a liquid droplet spray device.

The combination of the nozzle diameter with a protrusion portion allows expelling high-viscous liquids with very low stiction, even when using a high-density array of nozzles on the membrane section. Indeed, thanks to this combination of features, even large and heavy droplets will not wet the top surface of the membrane section.

Advantageously, the nozzle body may be made of silicon or any suitable material that is adapted to be processed with the required tolerance. In fact, membrane section 4*a* of the second substrate 4 of nozzle body 1 is the only part that needs to be made to critical tolerances.

Another example of a liquid droplet spray device containing a soft porous medium, indicated by reference 12, arranged within space 3 is shown in FIG. 6. As can be seen, a vibrating element 8*a* is arranged here in contact with second substrate 4 instead of with first substrate 2 as shown previously. Such arrangement should of course avoid impairing the transmission of the vibration to the liquid substance that is present in soft porous medium 6. The outlet means are not shown in detail, but are simply indicated by a dotted line 19*a*. However, the outlet means are of course similar to those shown in previous embodiments. A valve 13 may be provided for controlling the access of a reservoir (not shown) to the soft porous medium (or space 3), in a manner known to a skilled person.

As may be understood from the above embodiments, it is possible to reduce the use of silicon or the like as much as possible, i.e. to the nozzle body, or even only the second substrate, so that a cheaper device may be obtained by using suitable other materials for the remaining parts and corresponding micro-machining methods. Indeed, when using ion or proton beam micro-machining methods plastic, PET, PTFE or the like and resins may be used to create the first substrate 2 and the second substrate 4 from and within one piece, thereby obtaining a sufficiently precise and rigid, and thus reliable, device.

Having described a preferred embodiment of this invention, it will now be apparent to one of skill in the art that other embodiments incorporating its concept may be used. It is felt, therefore, that this invention should not be limited to the disclosed embodiment, but rather should be limited only by the scope of the appended claims.

The invention claimed is:

1. Nozzle body for a liquid droplet spray device for nebulising a high-viscous liquid substance having a viscosity of at least 4 mPas such as functional liquids, medicated or not, sanitizing or not, fragranced or not, comprising:

a first substrate in which a space is formed, a second substrate having one or more nozzle membrane sections and reinforcement sections, wherein said first and second substrates are arranged such to enclose the space, wherein each nozzle membrane section comprises a high-density array of outlet nozzles and output channels that connect said enclosed space with each of said outlet nozzles, said outlet nozzles and said output channels having a tightly-toleranced, straight, non-tapered shape, wherein said second substrate has a top surface in which at least one cavity is formed so as to provide said nozzle membrane section corresponding to the bottom of said cavity with surrounding reinforcement sections, and a bottom surface adjacent to and enclosing said space thus forming a chamber for containing said liquid substance, wherein each nozzle output channel is step-shaped with a wider portion adjacent said space and a thinner portion containing a protrusion section protruding beyond the top surface of said nozzle membrane section of said second substrate such that the exterior side wall of the protrusion section of said output channel is at a substantially straight angle with respect to the top surface of said nozzle membrane section of said second substrate, wherein said space consists of at least two sub-spaces separated by a flexible but leak-tight separation, each sub-space containing a different liquid to be ejected through said nozzle membrane section, and wherein the different liquids are ejected from different outlet nozzles.

2. Nozzle body according to claim 1, wherein said high-density array corresponds to an array having at least 85 outlet nozzles for a nozzle membrane section of 500 $\mu m^2$.

3. Nozzle body according to claim 2, wherein said high-density array corresponds to an array having at least 169 outlet nozzles for a nozzle membrane section of 500 $\mu m^2$.

4. Nozzle body according to claim 2, wherein said high-density array corresponds to an array having at least 300 outlet nozzles for a nozzle membrane section of 500 $\mu m^2$.

5. Nozzle body according to claim 1, wherein the viscosity of said liquid substance is at least 5 mPas.

6. Nozzle body according to claim 1, wherein said first and second substrates are formed integrally from one substrate by machining.

7. Nozzle body according to claim 1, wherein said space consists of a soft porous medium for containing the liquid substance.

8. Liquid droplet spray device for nebulising a high viscous liquid substance, comprising:

a nozzle body according to claim 1, and a vibrating element disposed to vibrate liquid in said space so as to eject said liquid substance as a spray through said outlet nozzles.

9. Liquid droplet spray device according to claim 8, wherein said vibrating element is attached to said nozzle body through removable attachment means.

10. Liquid droplet spray device according to claim 9, wherein said vibrating element is a piezoelectric element.

11. Liquid droplet spray device for nebulising a high viscous liquid substance, comprising:

a nozzle body according to claim 2, and a vibrating element disposed to vibrate liquid in said space so as to eject said liquid substance as a spray through said outlet nozzles.

12. Liquid droplet spray device for nebulising a high viscous liquid substance, comprising:

a nozzle body according to claim 3, and a vibrating element disposed to vibrate liquid in said space so as to eject said liquid substance as a spray through said outlet nozzles.

13. Liquid droplet spray device for nebulising a high viscous liquid substance, comprising:

a nozzle body according to claim 4, and a vibrating element disposed to vibrate liquid in said space so as to eject said liquid substance as a spray through said outlet nozzles.

14. Liquid droplet spray device for nebulising a high viscous liquid substance, comprising:

a nozzle body according to claim 5, and a vibrating element disposed to vibrate liquid in said space so as to eject said liquid substance as a spray through said outlet nozzles.

15. Liquid droplet spray device for nebulising a high viscous liquid substance, comprising:

a nozzle body according to claim 6, and a vibrating element disposed to vibrate liquid in said space so as to eject said liquid substance as a spray through said outlet nozzles.

16. Liquid droplet spray device for nebulising a high viscous liquid substance, comprising:

a nozzle body according to claim 7, and a vibrating element disposed to vibrate liquid in said space so as to eject said liquid substance as a spray through said outlet nozzles.

17. Nozzle body according to claim 1, wherein the flexible but leak-tight separation is a leak-tight vertical membrane.

18. Nozzle body according to claim 1, wherein the different liquids are ejected together through the same nozzle membrane section.

* * * * *